US006640994B2

(12) United States Patent
Chen

(10) Patent No.: US 6,640,994 B2
(45) Date of Patent: Nov. 4, 2003

(54) OPTICAL DEVICE FOR DETECTING A FALLING OBJECT

(76) Inventor: Jack Chen, 14 Kimberly Cir., Oak Brook, IL (US) 60521

( * ) Notice: Subject to any disclaimer, the term of this patent is extended or adjusted under 35 U.S.C. 154(b) by 46 days.

(21) Appl. No.: 10/078,791

(22) Filed: Feb. 19, 2002

(65) Prior Publication Data

US 2003/0155367 A1 Aug. 21, 2003

(51) Int. Cl.[7] ..... G07F 11/00
(52) U.S. Cl. ..... 221/2; 221/13
(58) Field of Search ..... 221/2, 3, 7, 9, 221/13, 17, 21, 92, 129, 131, 278; 194/317

(56) References Cited

U.S. PATENT DOCUMENTS 6,098,777 A * 8/2000 Hoffman et al. ..... 194/318
2001/0000610 A1 * 5/2001 Johnson ..... 221/13

* cited by examiner

*Primary Examiner*—Kenneth W. Noland

(57) ABSTRACT

A falling object, such as a product falling from a magazine to a discharge chute of a vending machine, is detected using a rectangular light curtain having parallel sides. A plurality of light emitters are positioned along one side and a plurality of receptors are positioned along another side opposite the emitters. A timing circuit momentarily illuminates the emitters one at a time at a time while an electronic controller examines the outputs signal from all the receptors. Where one of the receptors fails to receive a signal from one of the emitters an object is presumed to have interrupted the signal. To work properly the electronic controller must complete a cycle of illuminating all the emitters within the time frame that a falling object interrupts the light curtain.

12 Claims, 6 Drawing Sheets

OPTICAL DEVICE FOR DETECTING A FALLING OBJECT

The present invention relates to detectors of the type used in vending machines to detect that a product released from a magazine in the machine has fallen into a dispensing chute and, in particular, to a device for optically detecting that an object has fallen.

BACKGROUND OF THE INVENTION

A single vending machine can offer to the public a wide variety of products with each product marketed in a different sized package. A customer seeking to use the machine will deposit sufficient sums of money into the machine to pay for the product chosen and then use a keyboard or the like to select the desired product. After determining that the funds deposited are adequate to pay for the chosen product, an electronic controller in the machine signals a dispensing device for the magazine retaining the selected product. When the machine operates properly, the dispensing device removes one of the selected products from the magazine and allows it to drop into a chute which tapers down to a dispensing tray were it can be removed by the customer.

It has been found, however, that for any of a number of reasons, such machines sometimes fail to dispense a product. A product will not be dispensed if the selected magazine is empty or if the service personnel who last refilled the machine failed to insert products in all of the pigeon-holes of the selected magazine and the dispensing device attempted to dispense a product from an empty pigeon-hole. Even if there is product in the selected magazine, the dispensing device may be defective or jammed and be unable to carry out a dispensing cycle. A product dispensed from its dispensing device may also become stuck or hung up within the machine such that it is never available to the customer.

If a purchased product has not been dispensed to a customer, the customer is entitled to the return of the funds he has deposited in the machine. Existing vending machines have detectors for detecting whether a product has fallen through the chute to the tray for removal by the customer, and before refunding the customer's money, the electronic controller running the machine is programmed to attempt corrective measures. The electronic controller will first send a second a signal to the dispensing device for the selected magazine to dispense a second product. Where the dispensing device failed to dispense a product because of an empty pigeon-hole in a magazine, or because the dispensed product became jammed or hung up in the machine, a second dispensing may result in a product being properly dispensed.

If a product has not been detected as having dropped through the chute after the second attempt, the electronic controller might call for the dispensing of yet a third product. In fact, the electronic controllers of many existing vending machines are programmed to continue calling for the dispensing of product until a product has detected as having dropped through the chute or until a predetermined number of attempts have been made, after which the machine will refund the money deposited by the customer. The proper operation of such vending machines therefor require that a signal be sent to the electronic controller each time a product has been properly dispensed.

One method of accurately recording the dispensing of a product is to provide a detector, such as a microswitch, for monitoring the removal of every product in the machine. The network of detectors required to monitor all the products in the machine, however, would greatly complicate the manufacture of the machine and the electronics required would greatly increase its cost. Existing machines currently use ultrasonic devices or radio waves for detecting the movement of a product through the chute to the tray, however such detectors have not been entirely satisfactory. The equipment required to generate and receive electro magnet signals, essentially a radar, is expensive to manufacture and maintain. On the other hand, ultra sonic devices which detect the sound made as a product hits the tray at the bottom of the chute are easily compromised by a customer who reaches his hand into the tray to catch the falling product before it thumps against the walls of the chute or the tray. By catching the product, the acoustical detector fails to detect that a product has been dropped and the electronic controller signals for the dropping of a second product, which the customer might also catch. A customer with a degree of dexterity could catch a half a dozen falling products after paying for only one.

It would be desirable to provide an optical system which would use inexpensive LED emitters and detectors to detect a falling product because such a device could be easily integrated into the circuitry of the machine. Prior efforts to make a light curtain consisting of a plurality of LED emitters along one side of a dispensing chute and a plurality of LED detectors along the opposite side have not been successful because infrared light emitters do project a narrow beam of light. The light from one emitter is inevitably received by several or all of the detectors on the opposite side of the chute making it difficult for the micro-processor to discern when a object has fallen through the curtain. There is, therefore, a need to provide an optical detector for detecting the movement of a product through a chute which will overcome the problems encountered with respect to the use of infrared emitters and receivers.

SUMMARY OF THE INVENTION

Briefly, the present invention is an improvement to a vending machine of the type having a magazine for retaining a plurality of dispensable products. The machine has a dispensing means for dispensing one product in a magazine at a time. The machine further has a discharge chute through which dispensed products are dropped to an outlet tray. The discharge chute has a cross sectional area defined by a first side and a second opposing side, and the machine further includes a means for detecting that one of a plurality of dispensable products has passed through the cross sectional area.

In accordance with the invention, the means for detecting that a product has passed through the cross sectional area includes a plurality of optical emitters spaced along the first side of the chute with the emitters aimed towards the second side where a second plurality of spaced receptors are positioned to receive the signals from the emitters. The spacing between adjacent receptors is small enough that an optical signal from one of the plurality of optical emitters will be received by more than one of the receptors.

The invention further includes a sequencing circuit for sequentially illuminating each one of the optical emitters and a means for determining that one of the receptors has failed to receive a beam directed towards it from on of the emitters.

An important feature of the invention is that the sequencing circuit must complete a cycle of illuminating all the emitters forming the light curtain during the brief interval of time that a product is passing through the cross sectional area of the light curtain. The permitted interval of time can be determined by calculating the speed of the product after it has fallen out of the magazine to the light curtain and the vertical height of the product as it passes through the plane of the light curtain.

BRIEF DESCRIPTION OF THE DRAWINGS

A better understanding of the present invention will be had after a reading of the following detailed description taken in conjunction with the drawings wherein.

DETAILED DESCRIPTION OF THE PREFERRED EMBODIMENT

Figure 1:
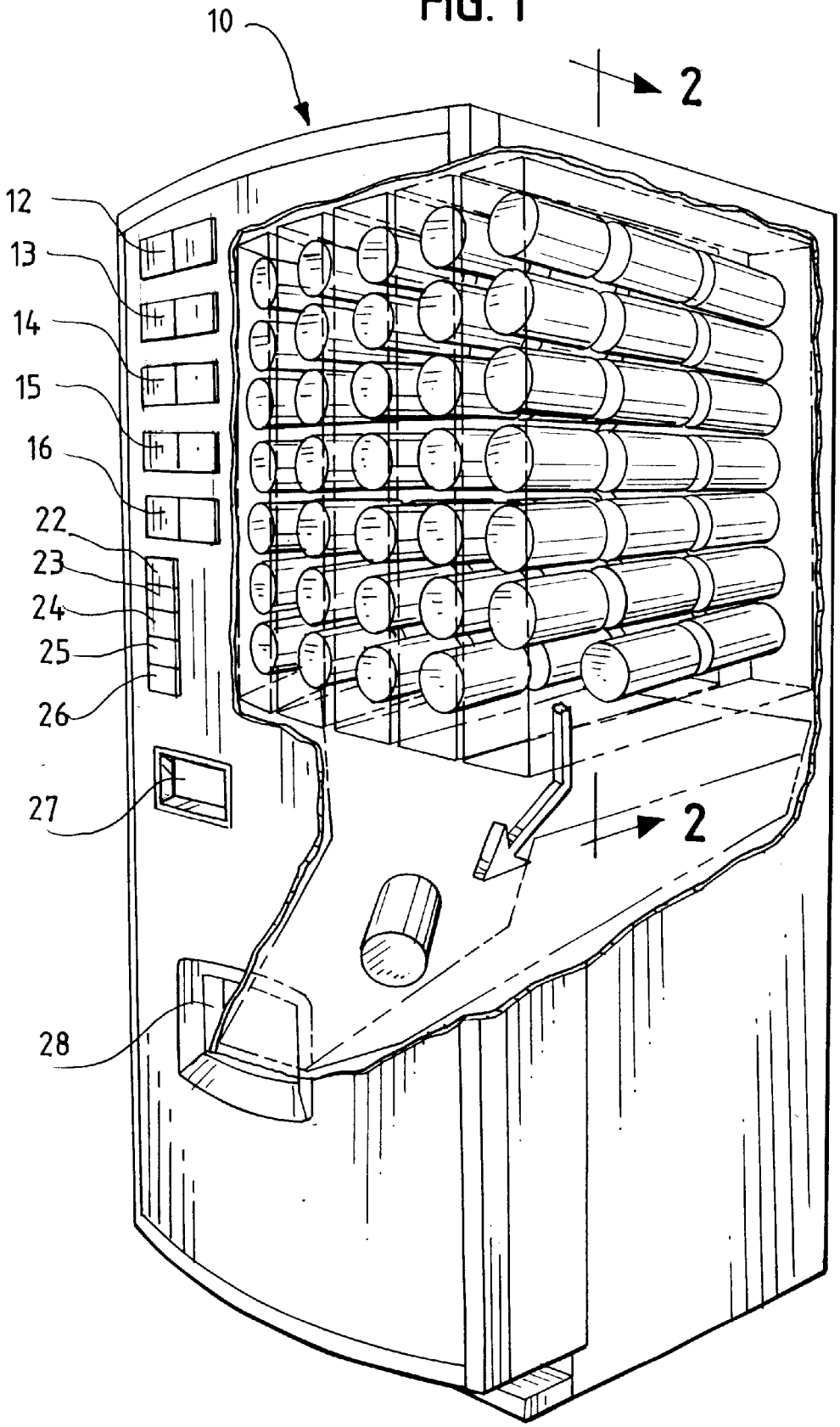
FIG. 1 is a schematic front elevational view of a vending machine incorporating the detector in accordance with the present invention.
Figure 2:
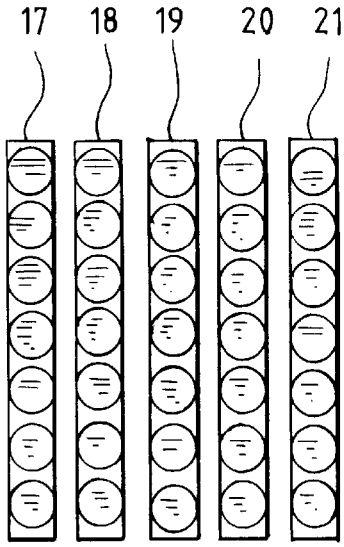
FIG. 2 is a schematic view of the plurality of magazines dispensing products in the machine shown in FIG. 1.

Referring to FIGS. 1 and 2, a vending machine 10 has a display portion consisting of a plurality of individual display windows, in this case five windows 12, 13, 14, 15, 16, with each window displaying a photo or a specimen of one of the products the machine offers for sale. Within the upper portion of the machine 10 are a plurality of vertically oriented magazines 17, 18, 19, 20, 21, with each magazine corresponding to one of the display windows 12, 13, 14, 15, 16. The forward surface of the machine 10 further includes selector buttons 22, 23, 24, 25, 26, a coin or currency receptor 27 and a discharge tray 28 positioned below the magazines 17–21.

Figure 7:
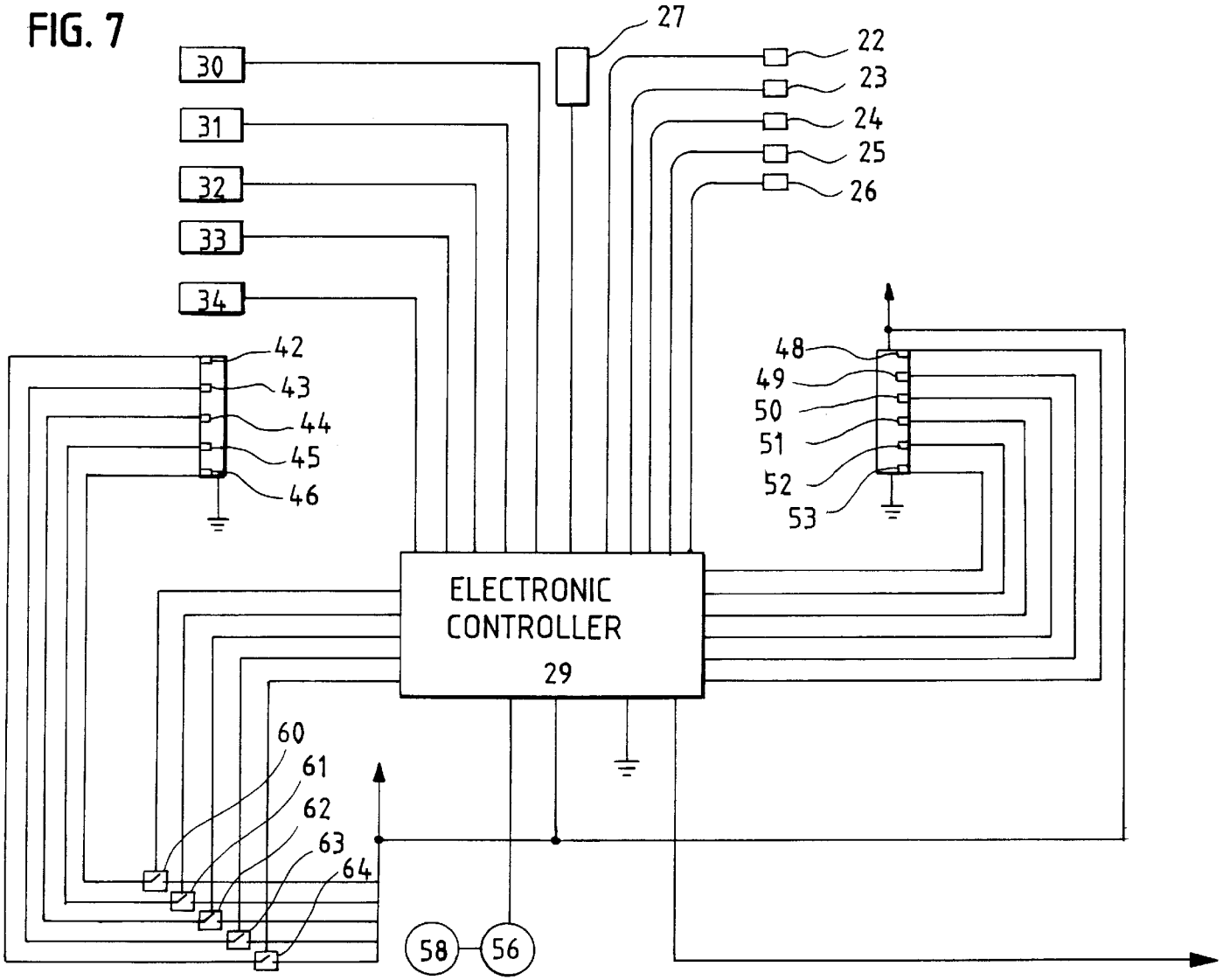
FIG. 7 is a schematic view of a circuit for generating the light curtain shown in FIGS. 6A–6E.

Referring to FIGS. 1, 2 and 7, a customer wishing to use the machine 10 will deposit a sufficient amount of money in the form of coins or currency into the receptor 27, then press one of the selector buttons 22–26 which corresponds to his choice of the product being displayed in the windows 12–16. An electronic controller 29, which may be a micro processor, receives input from the receptor 27 and from the selector buttons 22–26, and if the money deposited is sufficient to pay for the selected product, a signal is sent to a dispensing device, 30, 31, 32, 33, 34 for dispensing one of the products in the magazine 17–21 which corresponds to the window 12–16 displaying the product the customer selected for purchase. When the machine operates properly, the dispensing device 30–34 will dispense one of the products in the associated magazine 17–21. Once dispensed, the product will drop into a funnel shaped chute 35 which narrows to the dispensing tray 28 where it can be retrieved by the customer.

Referring to FIGS. 3 through 7, the machine 10 further includes a detector for detecting that a product 36 has fallen through a light curtain 37 which defines a plane across the upper end of the chute 35. Once the detector detects that a product 36 has fallen, the dispensing process is complete and the electronic controller will return to a start orientation where it can receive inputs from a new customer who wishes to purchase a product from the machine 10.

If the detecting device fails to detect that a product 36 has fallen within a given period of time, the electronic controller 29 will send a second signal to the dispensing device 30–34 associated with the selected magazine to dispense a second product 36. The cycle will be repeated until a product 36 has been detected falling through the light curtain 37 or until the electronic controller has reached a pre-programmed maximum limit of attempts, after which the machine will refund the money deposited by the customer.

Figure 3:
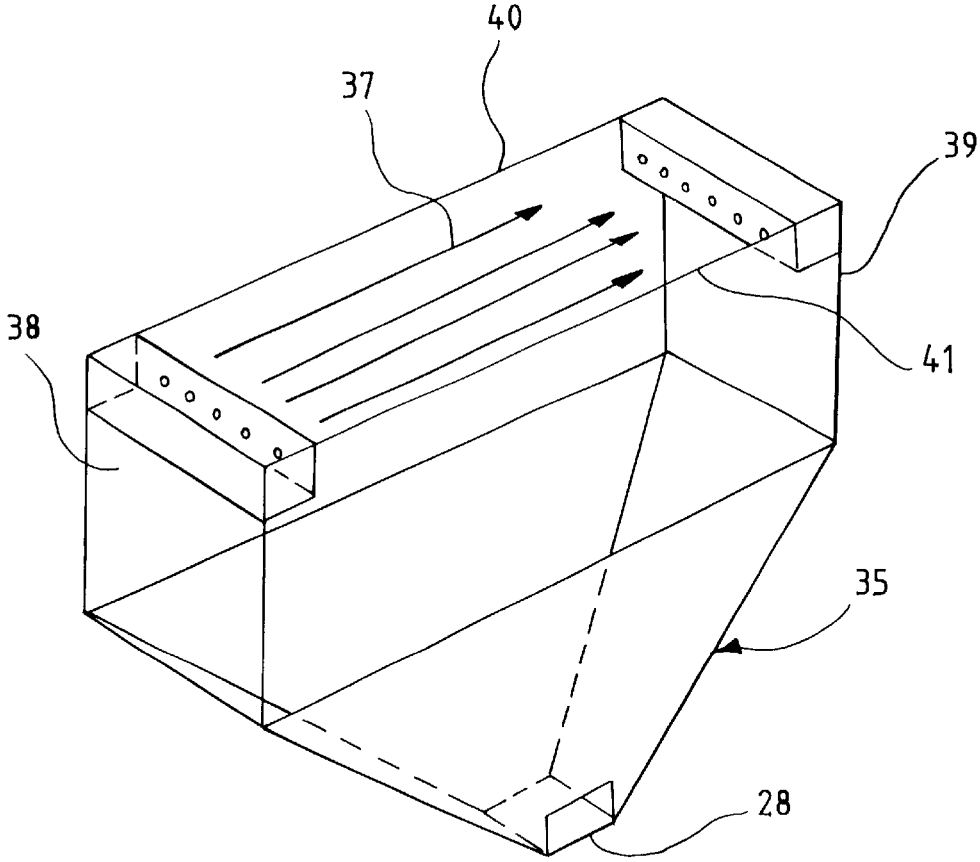
FIG. 3 is an isometric view of the light curtain and chute of the present invention.
Figure 4:
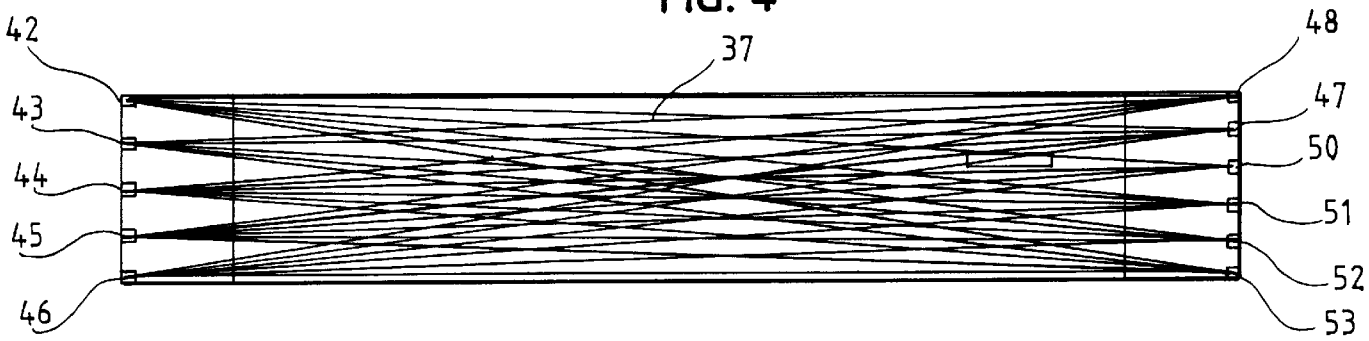
FIG. 4 is an enlarged schematic top view of the emitters and receptors which form the light curtain shown in FIG. 3 through which a product is dropping.

As shown in FIGS. 3 and 4, the light curtain 37 extends as a plane across a cross section of the upper end of the chute 35. The portion of the chute 35 containing the light curtain 37 is rectangular in shape with first and second opposing parallel short sides 38, 39 and opposing parallel long sides 40, 41. The light curtain 37 is formed by a plurality of emitters, in this case five emitters, sequentially numbered as 42–46, the light from which is directed across the length of the rectangular plane between long sides 40, 41 to a plurality of receptors, in this case six, sequentially numbered as 48–53.

Figure 6A:
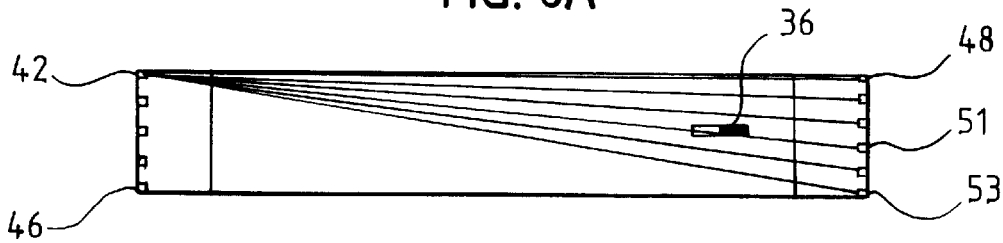
FIG. 6A is a schematic view of the light pattern from the first emitter showing the interruption of light to the receptors caused by a product dropping through the light curtain.
Figure 6B:
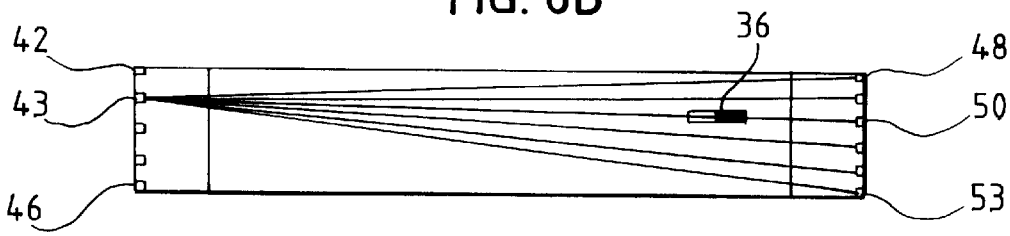
FIG. 6B is a schematic drawing showing the interruption of the light pattern caused by emitter two as the product falls through the light curtain.
Figure 6C:
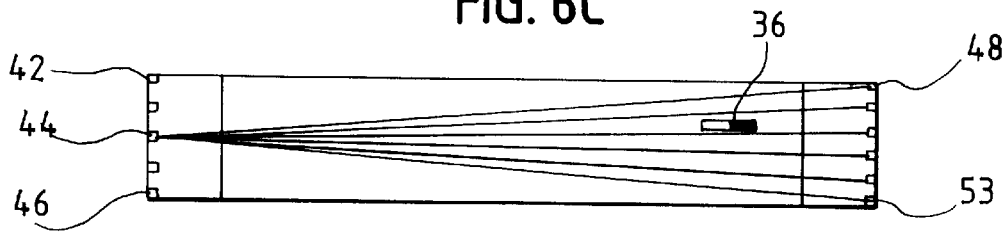
FIG. 6C is a schematic drawing showing the interruption of the light pattern caused by emitter three as the product falls through the light curtain.
Figure 6D:
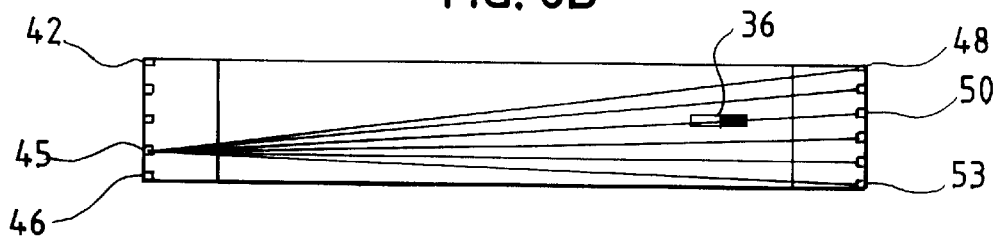
FIG. 6D is a schematic drawing showing the interruption of the light pattern caused by emitter four as the product falls through the light curtain.
Figure 6E:
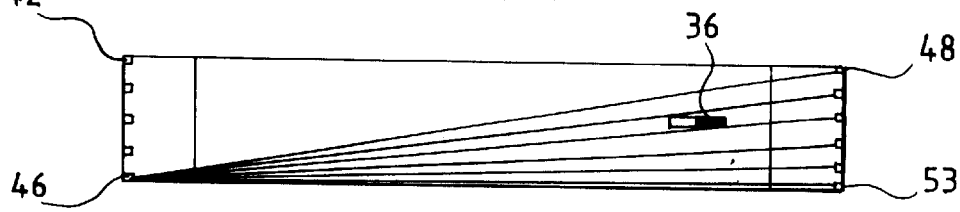
FIG. 6E is a schematic drawing showing the interruption of the light pattern caused by emitter five as the product falls through the light curtain.

Referring to FIG. 6A, the light emitted by an infrared LED emitter is not a narrow beam, but disbursed through an angle of approximately fifteen degrees such that light from the first emitter 42 is received by all six receptors 48–53. Similarly, as shown in FIGS. 6B through 6E, the light from each of the succeeding four emitters 43–46 is similarly received by all six of the receptors 48–53. If all five of the emitters 42–46 operate continuously and the receptors 48–53 continuously receive light from all five emitters, it is difficult to detect that a product 36 has broken the light curtain 37. For example, the product 36 is depicted in FIG. 6A as interrupting and preventing the light from emitter 42 from hitting receptor 51. At the same time, the product 36 blocks light from emitter 43 from reaching receptor 50 as depicted in FIG. 6B, and blocks light from emitter 45 from reaching receptor 50 as depicted in FIG. 6D.

The problem is that even though the light from some of the emitters is blocked to some of the receptors, all of the receptors continue to receive light from other emitters. Prior art efforts to use a light curtain as a detector have employed circuits to measure the intensity of light reaching the receptors, the presumption being that when a product has dropped through the light curtain the signal from one of the receptors 48–53 will drop below a given output level. Such devices require a high degree of sensitivity to accurately measure the output from the various receptors 48–53. It also requires that all the emitters produce substantially the same intensity of light output because a weak emitter will produce a false signal that a product has dropped. Because of the forgoing such detection devices have been found to be less than satisfactory.

Figure 5:
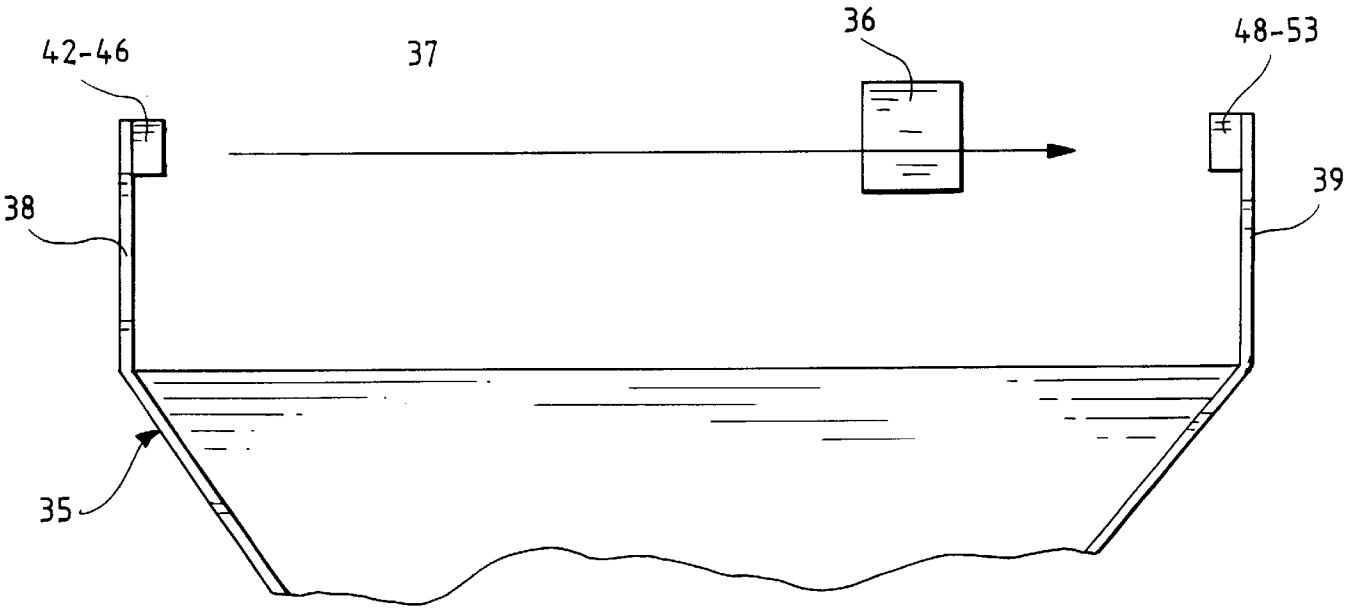
FIG. 5 is an enlarged schematic side elevational view of the light curtain shown in FIG. 3 through with a falling product passing through the light curtain.

Referring to FIGS. 5 through 7, the present invention includes a timing circuit 56 including a clock 58 for operating a plurality of switches 60–64, one switch controlling power to each of the emitters 42–46 respectively. The timing circuit 56 opens each of the switches 60–64 to emitters 42–46 in succession for a brief interval of time, allowing a flash of light from each emitter 42–46 in sequence, beginning with the first emitter 42 and ending with the last emitter 46, as a continuously repeated cycle. The electronic controller 29, which also controls the timing circuit 56, is programmed to look for pulses from each of the six receptors 48–53 as they respond to the flash of the successive emitters 42–46. Where one of the receptors 48–53 fails to receive a flash of light from one of the emitters 42–46 the presumption is that the light from that emitter has been interrupted by a falling product 36 breaking the light curtain 37.

Referring further to FIGS. 5 and 6A–6E, an important requirement to the proper operation of the invention is that the timing circuit go through the sequence of illuminating all the emitters 42–46 within the time consumed while the falling product 36 is passing through the light curtain 37. A product that drops three feet is accelerated by the force of gravity to a speed of about fourteen feet per second. If the height of the falling product is a little more than one inch, the product will interrupt the curtain for about 0.006 seconds. The timing circuit 56 can easily be programmed to sequence all five emitters 42–46 within the 0.006 second window.

Figure 8:
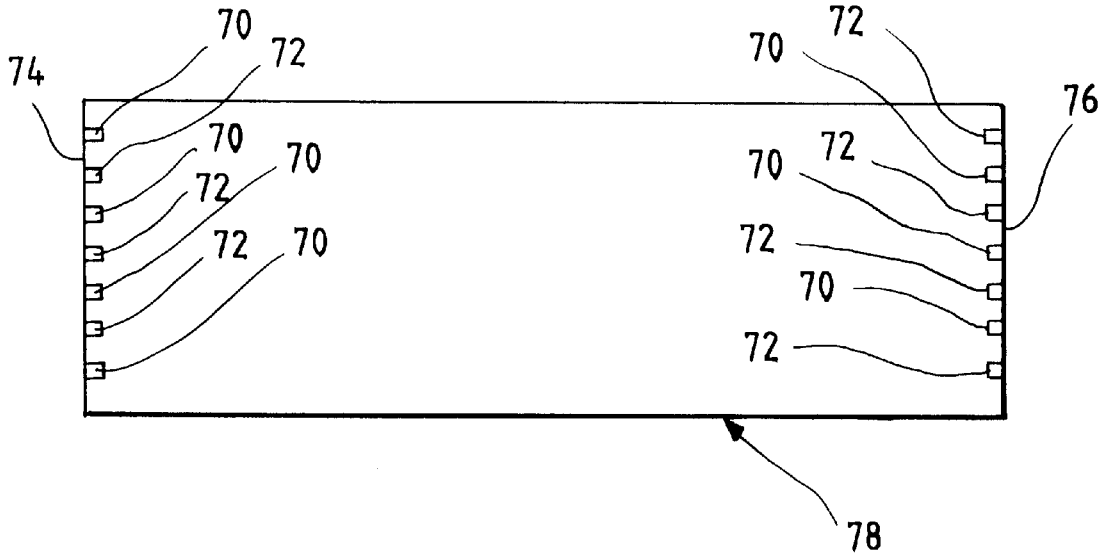
FIG. 8 is a schematic drawing of emitters and receptors configured in accordance with another embodiment of the invention.

It is not necessary that all the emitters be positioned along one side of a light curtain and all the receptor be positioned along the opposite side. Referring to FIG. 8, the emitters 70 and the receptors 72 could be located in alternating positions along opposing sides 74 and 76 of a chute 78 as depicted. With the emitters 70 and receptors 72 in this configuration the electronic controller 29 and timing circuit 65 perform exactly as described above.

Figure 9:
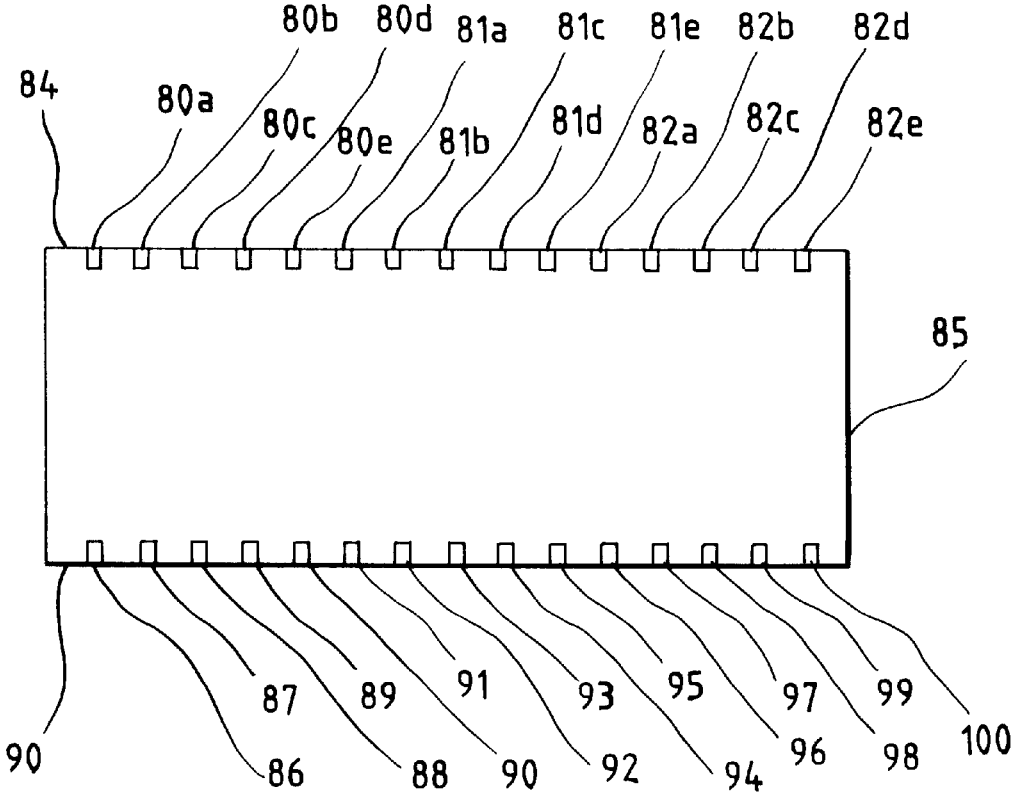
FIG. 9 is a schematic drawing of emitters and receptors configured in accordance with yet another embodiment of the invention.

It would also be within the scope of the invention to position the emitters and receptors along the long walls of the chute. Referring to FIG. 9, where the emitters 80*a*–80*e*, 81*a*–81*e*, 82*a*–82*e* are positioned along one long wall 84 of chute 85 and the receptors 86–100 are positioned along the opposing long wall 102, it is not necessary for the sequencing circuit 56 to sequentially illuminate all of the emitters beginning with 80*a* and ending with 82*e*. The emitters can be arranged in groups, and three groups of five emitters each are depicted in FIG. 9, group 1 being 80*a*–80*e*, group 2 being 81*a*–81*e*, and group 3 being 83*a*–83*e*. With the emitters and receptors in this configuration emitters 80*a*, 81*a* and 82*a* could be simultaneously illuminated for a brief interval of time, followed by the simultaneous illumination of emitters 80*b*, 81*b* and 82*b*, then by the simultaneous illumination of emitters 80*c*, 81*c* and 82*c*, then by the simultaneous illumination of emitters 80*d*, 81*d* and 82*d*, and finally by the simultaneous illumination of emitters 80*e*, 81*e* and 82*e*, after which the cycle is begun again. An important consideration of this configuration is that when emitter 81*a* is illuminated, the electronic controller 29 should look for a signal indicating light is being received by receptors 89, 90, 91, 92 and 93, because these are the receptors aligned across from emitter 81*a*. Another consideration is that the emitters and the receptor must have sufficient spacings along the long walls 84, 102 so that each receptor 86–100 receives light from only one illuminated emitter at a time.

While the present invention has been described with respect to a single embodiment, many modifications and variations may be made without departing from the true spirit and scope of the invention. It is, therefore, the intent of the appendant claims to cover all such modifications and variations which fall within the true spirit and scope of the invention.

What is claimed is:

1. In a vending machine having a magazine for retaining a plurality of dispensable products, dispensing means for dispensing said plurality of dispensable products from said machine one at a time, a discharge chute through which a dispensed product will drop, said discharge chute having a cross sectional plane defined by a first side and a second opposing side, and means for detecting that one of said plurality of dispensable products has been dispensed, the improvement comprising a plurality of optical emitters paced along said first side, said optical emitters aimed at said second opposing side, a plurality of receptors spaced along said second opposing side, a sequencing circuit for sequentially illuminating each one of said optical emitters, and means for determining when light from one of said plurality of optical emitters aimed at one of said plurality of receptors has failed to reach said one of said receptors.

2. A vending machine in accordance with claim 1 wherein said plurality of optical emitters are LED's.

3. A vending machine in accordance with claim 1 wherein said plurality of optical emitters emit infra red light.

4. A vending machine in accordance with claim 1 wherein said sequencing circuit completes a cycle of successively illuminating all of said emitters within 0.01 seconds.

5. A device for detecting that an object has fallen from a discharge, said device comprising a light curtain defined by a first side and an opposing second side, a plurality of optical emitters spaced along said first side, said plurality of optical emitters aimed toward said second side, a plurality of receptors along said second side, means for successively illuminating said plurality of optical emitters one at a time, and means for determining that light aimed at one of said plurality of receptors from one of said plurality of optical emitters has failed to reach said one of said plurality of receptors.

6. A device in accordance with claim 5 wherein said plurality of optical emitters are LED's.

7. A device accordance with claim 5 wherein said plurality of optical emitters emit infra red light.

8. A device in accordance with claim 5 wherein said means for successively illuminating completes a cycle of successively illuminating all of said emitters within 0.006 seconds.

9. A vending machine comprising a magazine for retaining a plurality of products, a cash receptor for receiving money from a customer, a discharge chute, a discharge device for discharging said plurality of products one at a time, means for initiating said discharge device upon receipt of a signal from said cash receptor that a purchase price has been paid, means for detecting that a product has fallen from said magazine to said discharge chute, said means for detecting including a light curtain made up of a plurality of optical emitters, and sequencing means for sequentially illuminating said plurality of emitters.

10. A vending machine in accordance with claim 9 wherein said plurality of optical emitters are LED's.

11. A vending machine in accordance with claim 9 wherein said plurality of optical emitters emit infra red light.

12. A vending machine in accordance with claim 9 wherein said sequencing circuit completes a cycle of successively illuminating all of said emitters within 0.006 seconds.

* * * * *